US005456808A

United States Patent [19]

Juric

[11] Patent Number: 5,456,808

[45] Date of Patent: Oct. 10, 1995

[54] METHOD FOR OPERATING A CONTINUOUS PREBAKED ANODE CELL BY LOCATING RESISTANCE REDUCING MATERIALS TO CONTROL THE RATE OF HEAT EXTRACTION

[75] Inventor: Drago D. Juric, Camberwell, Australia

[73] Assignee: Comalco Aluminium Limited, Victoria, Australia

[21] Appl. No.: 211,716

[22] PCT Filed: Nov. 6, 1992

[86] PCT No.: PCT/AU92/00599

§ 371 Date: Apr. 22, 1994

§ 102(e) Date: Apr. 22, 1994

[87] PCT Pub. No.: WO93/09274

PCT Pub. Date: May 13, 1993

[30] Foreign Application Priority Data

Nov. 7, 1991 [AU] Australia ..... PK9368

[51] Int. Cl.[6] ..... C25C 3/08

[52] U.S. Cl. ..... 204/67; 204/222; 204/223; 204/243 R; 204/245; 204/286; 204/297 R

[58] Field of Search ..... 204/67, 198, 222, 204/223, 243 R, 245, 286, 297 R, 239, 241; 373/94; C25C 3/08, 3/10, 3/12

[56] References Cited

U.S. PATENT DOCUMENTS

| | | | |
|---|---|---|---|
| 2,958,641 | 11/1960 | Reynolds | 204/286 |
| 4,608,134 | 8/1986 | Brown | 204/67 |
| 4,608,135 | 8/1986 | Brown | 204/67 |
| 4,749,463 | 6/1988 | Holmen | 204/241 |
| 5,071,534 | 12/1991 | Holmen et al. | 204/67 |
| 5,364,513 | 11/1994 | Sekhar et al. | 204/243 R |

FOREIGN PATENT DOCUMENTS

| | | |
|---|---|---|
| 0269534 | 6/1988 | European Pat. Off. . |
| 0380300 | 8/1990 | European Pat. Off. . |

OTHER PUBLICATIONS

F. H. Dethloff, "Heat Recovery From Pot Gas From Electrolytic Reduction Cells for Producing Aluminium", (1983).

*Primary Examiner*—Kathryn Gorgos

*Attorney, Agent, or Firm*—Nikaido, Marmelstein, Murray & Oram

[57] ABSTRACT

A support structure for supporting continuous prebaked anodes in an aluminium smelting cell comprises a pair of side plates (3) and a pair of end plates (4) connected together to form an enclosed superstructure. The supporting structure includes at least one pair of spaced cross-plates (8, 9) that are configured to provide wedging surfaces which act to support an anode (14) therebetween. Electrical current is fed to the anodes via the cross-plates. Respective pairs of cross-plates supporting adjacent anodes may be spaced to define heat exchange passages which can be used to control the temperature of the support structure. A method for operating an aluminium smelting cell at variable amperage by positive and controlled extraction of heat from the cell is also described.

13 Claims, 9 Drawing Sheets

FIG.1
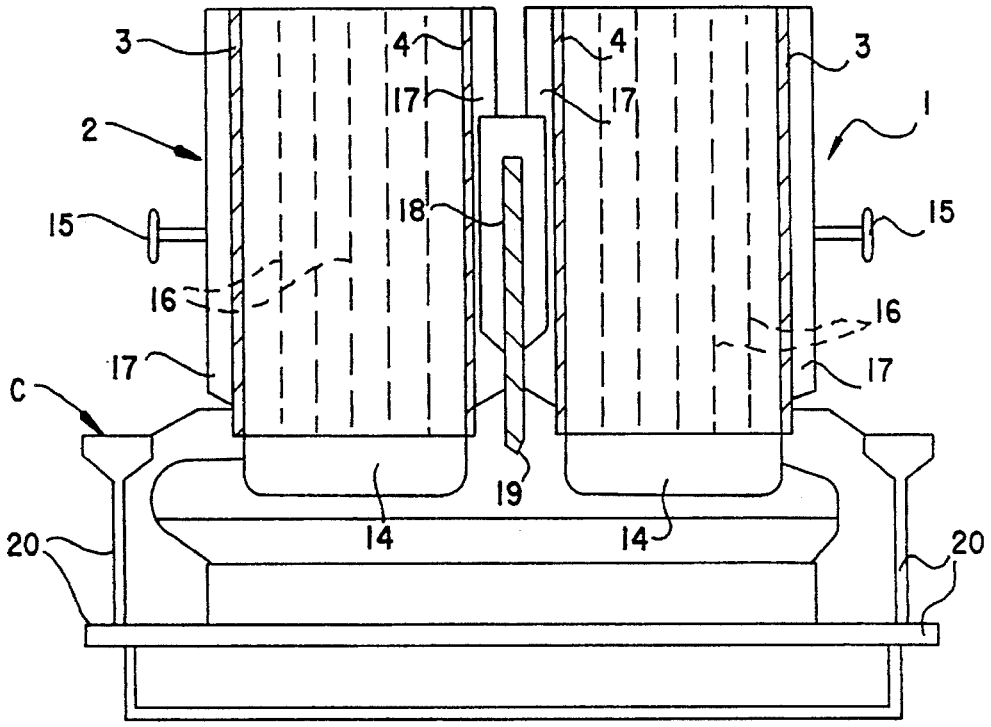
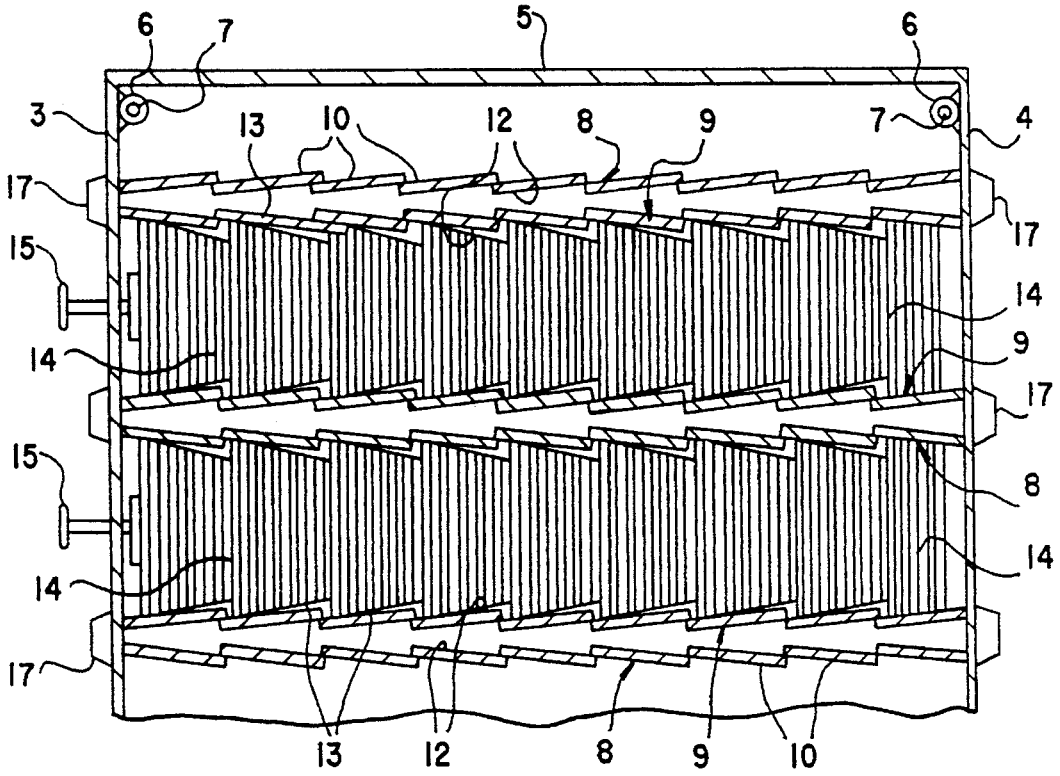
FIG.2

SUPERHEAT = 8.2c

A C D = 0.058m

SUPERHEAT = 6.3c

A C D = 0.059m

SUPERHEAT = 9.1c

A C D = 0.056m

SUPERHEAT = 8.2 c
A C D = 0.059m

SUPERHEAT = 10.5c
A C D = 0.060m

METHOD FOR OPERATING A CONTINUOUS PREBAKED ANODE CELL BY LOCATING RESISTANCE REDUCING MATERIALS TO CONTROL THE RATE OF HEAT EXTRACTION

FIELD OF THE INVENTION

This invention relates to aluminium smelting cell improvements aimed at facilitating the use of continuous prebaked anodes, and more particularly relates to improved anode support structures as well as preferred support structure arrangements which enable associated improvements in cell efficiency. The present invention also relates to a method of operating an aluminium electrolysis cell.

BACKGROUND OF THE INVENTION

The conventional aluminium smelting technology which uses discontinuous prebaked anodes has major limitations in the areas of electrical energy efficiency, environmental pollution and worker health. Replacement of anodes contributes to low power efficiency and high fluoride emissions from pots, potrooms, butts processing areas and baking furnaces. Anode replacement involves a number of activities which are necessitated by the need to access the pots, remove spent anodes, add new anodes, cover these up, recover anode rods, cast iron and carbon from spent anodes, clean, crush and reprocess butts, return butt bath to the pots, etc. All this adds to the cost of production and to environmental and health problems.

The conventional strategy used to deal with problems emanating from anode replacement has been to learn to live with them by alleviating their impact on worker health and safety and to reduce their cost through better economies of scale and increased mechanisation. The aluminium industry has in the past developed butts cleaning technology and currently is looking for better ways of handling anodes, butts and bath and reducing pot emissions in potrooms. The underlying problem with this strategy is that no matter what is done with anode replacement and how this is done, no value is being added to the metal produced, or to any of the by-products of the process.

The discontinuous anode technology has impacted on the smelting technology in a number of ways. Cell design and construction, plant design, layout and capital infrastructure have all been affected. Apart from these, there are a number of jobs and operations which stem from anode replacement, all of which add to the cost, but not to the value of metal produced. These are: anode setting, butts handling, cleaning, crushing and grinding, bath crushing and handling, oreing-up of pots, anode rodding, fume treatment and others. Each of these steps and processes require significant capital investment and incur substantial operating costs.

The need to access the pots to replace anodes has meant that pots could not be adequately sealed. Excessive air flow rates are used to effectively purge the pots to keep the pot emissions in potlines down. During anode setting, the pots have to be opened and large volumes of fumes are released into the potroom atmosphere from open anode hole. Spent hot butts are often left in the potrooms to cool off before moving. Gaseous fluorides are produced by a reaction between the hot butts and moisture in the air which is drawn in from outside by the potroom and pot ventilation systems. This strategy of using large volumes of air to effectively purge the potlines and pots in order to keep the concentration of hazardous HF gas down, is doubly self-defeating. On the one hand, purging gas (atmospheric air) is the principal source of the hazard (HF production is directly proportional to the amount of moisture in the air), and on the other, the hazardous gas becomes so diluted that a very large and very efficient scrubbing system is required to achieve environmentally safe fluoride discharge levels.

Recycling of butts leads to introduction of fluoride salts into green anodes. These can react with hydrogen in the pitch binder during baking to give off HF. At higher temperatures, fluoride salts can also be vaporized. Fluorides contaminate the flue gas, react with refractories and accelerate the flue walls failures. Baking furnace flue gas is a major source of fluoride emissions which in the future may require scrubbing.

Anode replacement has negative influence on the pot operations and its efficiency. A large mass of alumina and frozen crust falls into the bath during anode setting. Most of this alumina can not dissolve and ends up forming sludge. A freshly set cold anode chills off the bath, and this may cause the alumina being fed during the post setting period to remain undissolved due to lack of superheat. This forms additional sludge. The bath freezes on the anode surface preventing it from drawing current for several hours. This, not only increases the pot resistance, but causes current imbalance which may change the shape of metal pad profile and thus lead to a loss of current efficiency due to different anodes having different ACD's. All this limits the minimum voltage a cell can operate at and has a direct effect on its production efficiency and costs.

For all of the above reasons, the advantages to be gained by the use of continuous prebaked anodes deserve closer attention. Such advantages include:

(i) Lower capital costs through the elimination of the butts circuit and the rodding room facility.

(ii) The production of high purity metal (99.9% Al) through the absence of recycled butts impurities. The iron level is, for example, expected to be below 0.03 wt %.

(iii) The absence of butts impurities which will have a beneficial effect on the excess carbon consumption caused by air burn and carboxy reactivity.

(iv) Increased life of baking oven flue walls resulting from the absence of corrosive bath components normally contained in recycled butts.

(v) Lower bath losses because anode butts are not continually removed from the cell.

(vi) Lower cell fluoride emissions and easier control of bath chemistry because the crust is broken less frequently.

(vii) Decreased frequency of metal pad disturbances, because the regular setting of cold anodes is eliminated.

(viii) More effective utilization of the total cathode area achieved by eliminating the center channel and employing larger anodes that span the width of the cell.

(ix) Decreased effective current density by about 5–10%, through the elimination of "dead" anodes during cold anode changes.

Continuous prebaked anode technology first appeared in the early 1960's. A number of problem areas limited the effectiveness of the technology. Early operations were plagued with anode separation problems due to glue failures, although this has since largely been resolved. The current feeder technology was based on the horizontal stud Söderberg concept in which current was conducted to the anodes by four steel studs pressed into the ends of the anode at a sloping angle of about 20° downward to allow for quicker fast and better electrical contact. However, this created strong vertical magnetic fields in the cell and aggravated the already existing bad magnetic design of the end-to-end cells. Absence of effective anode insulation and cover led to high top heat losses and significant anode airburn. In spite of these shortcomings, the continuous prebaked technology was able to demonstrate the advantages of increased metal purity, improved environmental control, reduced bath material consumption and reduced labor requirement mentioned above.

Other designs for continuous pre-baked anodes have also been described. Australian Patent Application No. 48715/90, by Norsk Hydro A. S. describes an aluminium electrolysis cell having a continuous anode. The anode is divided into a number of easily detachable cassettes or holders which provide for continuous feeding of carbon anodes. Additional cassettes containing equipment for the supply of additives such as alumina, to the bath are located between the anode-holding cassettes. The cassettes have projections located on their upper portion and these projections rest on vertically movable bars to thereby support the cassettes.

The construction of a preferred form of the cassettes is shown in FIGS. 3–5 of the patent. Each cassette includes an upper part having a guide for the carbon anodes. The lower part of the guides comprises a holder arrangement in the form of a clamping device connected to the upper parts of the guides by means of elongate stays. The clamping arrangement and associated stay are located at each corner of the carbon anode and do not extend completely around the periphery of the carbon anode. The holder arrangement holds the stack of carbon blocks by means of frictional force. The holder arrangement also conducts electricity to the anode carbon.

The clamping devices on each corner of the anode block are connected to each other by cross stays. Swallow tail grooves are placed along the long side of the anodes in order to provide extra electrical current contacts to improve current distribution in the anode. Force is applied to the clamping means by way of lifting intermediate stays which acts to bend the cross stays and pull the clamping arrangements on each corner closer together.

In a preferred embodiment, the cassettes are provided with cooling conduits to reduce the temperature in the cassette walls. As shown in FIG. 5 of the patent, the clamping arrangement and associated stays are provided with bores or conduits to allow the circulation of a cooling fluid therein.

The arrangement described in AU,A,48715/90 provides clamping members located only at the corners of the anode blocks. As a result, large surfaces of the anode carbon are exposed which causes considerable potential for anode burn. Further, as the clamping members provide electrical contact for the anode carbon, current distribution in the anode is not optimal. The clamping members are capable of being cooled by a cooling fluid to control the temperature in the cassette walls. However, substantially no heat is recovered from the surfaces of the anode carbon that do not contact the clamping means, and this represents a loss of heat. The anode structure is also made from a number of separate cassettes, which increases the complexity and cost of fabrication of the anode structure. If cooling is provided, the clamping means must also include conduits or bores, which further adds to the complexity and cost of the anode structure.

U.S. Pat. No. 2,958,641, assigned to Renyolds Metals Company, describes an anode "bundle" for use in aluminium electrolysis cells. The anode "bundle" includes a pack of pre-baked carbon slabs interleaved above their lower ends with steel plates. The bundle of slabs and plates are secured by a clamping means. The anode block is described as having a service life of between 30 and 60 days and is not used as a continuous anode. Indeed, each anode includes anode cap assemblies connected to the top thereof and such cap assemblies would preclude operation of the anode as a continuous anode. Furthermore, large areas of the anode surface are exposed to the atmosphere and the potential for anode burn is accordingly high.

Several patents and literature articles have also discussed heat recovery from aluminium electrolysis cells. In this regard, U.S. Pat. Nos. 4,608,134 and 4,608,135 describe cooling of the side wall of an electrolysis cell at a site adjacent the surface of the molten bath to promote the formation of a protective layer of frozen bath over the side wall adjacent the cooling means. The heat recovered from the side wall is subsequently returned to the cell. Both of these patents are concerned with prevention of freeze-up of low power cells that are operated at substantially constant power inputs. Except for the cooling means included in the side wall, the cells are essentially conventional in design.

An article in "Light Metals", 1983, by P. H. Dekloff, entitled "Heat Recovery from Pot Gas from Electrolytic Reduction Cells for Producing Aluminium" describes the recovery of energy from the off-gas from aluminium smelting cells. Heat from the smelting cells is lost to the off-gas by passive heat transfer and subsequently recovered remote from the cell. The overall heat balance of the cell is not affected by the recovery of heat from the off-gas.

SUMMARY OF THE INVENTION AND OBJECT

It is an object of the present invention to provide an improved support structure for supporting continuous prebaked anodes within an aluminium smelting cell.

The invention, therefore, provides a support structure for supporting continuous prebaked anodes in an aluminium smelting cell, comprising a pair of rigid side plates and a pair of rigid end plates rigidly connected to define an enclosed supporting superstructure, at least one pair of spaced rigid cross plates configured to provide wedging surfaces against which side surfaces of a continuous prebaked anode can be held by clamping means supported by one of said side plates, means for introducing electrical current into said cross plates, and elevating and lowering means carried by said supporting superstructure to facilitate proper positioning of the anode and feeding of the anodes with respect to the supporting structure.

Preferably, the anodes are shaped such that the anode side surfaces correspond to the wedging surfaces.

The supporting structure defined above has the advantage of being able to be made in a particularly rigid manner since the clamping of the continuous anodes is achieved by wedging movement of the anodes with respect to the supporting structure rather than by movement of parts of the supporting structure with respect to the anodes. This significantly reduces the complexity of the supporting structure and enables it to be made in a manner which leads to greater rigidity in a mechanically simple manner.

In an alternative embodiment, the wedging surfaces are provided by wedging members adapted to be positioned between the anode and the cross plates. In this embodiment, the simplicity and rigidity of the support structure are not affected by the use of wedging members.

The cross plates are preferably "riffled" or serrated or scabbled by the formation of the cross plates from a multiplicity of inwardly sloping plate elements joined to provide a series of connected wedging surfaces against which corresponding surfaces of the anode may be wedged by a suitable wedging clamp mounted on one of the side plates. The wedging clamp may take any suitable form, such as a simple threaded jack mechanism mounted on a side plate.

In any commercial cell, multiple anodes will be supported along the length of the cell. In a preferred supporting structure, the supporting cross plates for adjacent anodes are spaced to define a heat exchange path for controlling the heat balance of the cell in an orderly way and for extracting usable heat from the anodes and to maintain the temperature of the cross plates in a suitable range, which generally may be below 600° C. In this way, the rigid support structure for the anodes also performs a heat exchange function. It will also be appreciated that the heat exchange path may be defined by the use of hollow cross plates.

Preferably, at least one of the cross plates includes at least one current carrying member located in electrical contact with said cross plate. The current carrying member may comprise a bar mounted near and generally parallel to a lower end or an upper end of the cross plate. The bar may be produced from any suitable material having a high electrical conductivity, with copper being the preferred material. The bar may further comprise a vertical riser portion adapted to be placed into electrical contact with the current carrying bus-bars of the cell.

Inclusion of a current carrying member in the anode structure allows the current to be fed to the anode at a position close to the bottom of the anode in cells where magnetic disturbances are not a problem, such as drained cathode cells, and thus, near the working surface of the anode. As a result, voltage losses in the anode structure can be reduced compared to conventional cells, which generally feed current to the anode from the top of the anode. Furthermore, the current carrying member, in being located closer to the ground than the current feed for conventional anodes, allows the bus-bars and associated electrical feeders located external to the cell to be placed closer to the ground. As industry practice is to feed the cathode current from one cell to the anode of the next cell, the lower vertical height of the electrical feeders on the anode reduces the required length of the electrical feeders. Accordingly, lower electrical losses can be obtained.

The supporting superstructure may be supported for elevating and lowering movements by any suitable means, such as supporting legs near each of the corner of the supporting superstructure with each leg housing a suitable jacking mechanism, such as a known screw jack.

The side plates and end plates are preferably connected to define an enclosure which cooperates with the rest of the cell structure to substantially fully enclose the cell to ensure the proper collection of off gases and to reduce heat losses.

Apart from the corresponding wedging surfaces referred to above, the continuous prebaked anodes are conventional in construction and comprise anode block elements glued or otherwise joined to each other in a vertical stack. Preferably, the anode blocks are riffled or serrated at their joining faces to facilitate better contact between the blocks and improved glue adherence.

In order to lower the electrical contact resistance between the cross plates and the anodes, the anodes are preferably coated with sprayed aluminium. Alternatively, an aluminium cement or aluminium powder may be applied as a contact medium between the cross plate and the anode. Use of aluminium for this purpose has been made possible by the above described forced cooling of cross plates which can be maintained at temperatures below the melting point of aluminium.

The cross plates may be coated with an electrically conducting material which is wetted by and resistant to molten aluminium. For example, the coating material may be a metal, such as molybdenum, copper or chromium. Alternatively, a refractory hard metal boride or carbide may be used. Suitable examples include $TiB_2$, TiC and $ZrB_2$. The coating may be applied by any suitable method, such as plasma, arc or gas spraying technique. Alternatively, the coating may be produced by electrodeposition.

The present invention also provides a method for operating an aluminium electrolysis cell which utilizes the advantages above defined support structure.

Accordingly in a further aspect, the present invention provides a method for operating an electrolysis cell used for the production of aluminium, which cell includes a shell having a bottom and side walls, a cathode, anodes located above said cathode, where said anodes are supported by an anode support structure, and an electrolysis bath being located between said cathode and anodes; the cell being arranged to enable positive and controlled heat extraction to take place therefrom, which method comprises supplying electrical power to the cell, monitoring one or more operating parameters in the cell, and controlling the rate of heat extraction from the cell to maintain one or more of the operating parameters within set limits, wherein the rate of heat extraction from the cell can be controlled to permit operation of the cell at varying amperage.

The method of the present invention allows aluminium electrolysis cells to be operated at variable amperage without causing deleterious effects on the operation of the cell. Conventional aluminium electrolysis cells rely upon natural cooling processes to dissipate heat and, therefore, require a constant heat input and heat loss conditions to maintain stable operations. In order to maintain heat balance, power input can be varied slightly to keep up with changes in pot condition and operating efficiency.

The current technology cells have been designed and operated in a thermal condition which approaches the limits for alumina dissolution. This is done in order to reduce power consumption, but such cells are sensitive to changes in heat balance. Cell warming causes the ledge and crust to melt, thus altering the chemical and physical properties of the electrolyte and increasing the heat losses from the cell. Cell cooling, however, is not a simple reversal of cell warming. Initial cooling causes the ledge to freeze on the sidewall and bath composition to change and volume to shrink away from the crust. Reduced bath volume, increased acidity and reduced superheat cause the alumina fed to the pot to remain undissolved and form a sludge on the bottom of the cell. Sludge is hard to control and its presence can lead to operating difficulties. Operating excursions into regions outside proper heat balance are major causes of loss of operating efficiency in reduction cells. Therefore, current technology cells operate at essentially constant power inputs.

In contrast, the method of the present invention utilizes positive and controlled heat extraction from the cell, which allows the cell to be satisfactorily operated at varying amperages. The ability to operate the cell at varying amperage provides greater flexibility in operation and can result in the following benefits:

i) Use of off-peak electricity—the amperage may be varied on a daily basis to maximize metal production during off-peak periods when electricity prices are lower, thus decreasing the production cost of metal.

ii) heat recovery and power co-generation—the heat recovered from the cell can be used to generate electricity, which may be used on-site or sold back to the electricity grid. Alternatively, the heated air could be used to produce steam, which could be used for power generation, bauxite digestion or sold to other users of steam located near the site.

iii) the anode structure of the cell can act as a heat storage bank during off-peak, variable amperage operation. During high amperage operation of the cell at off-peak times, the extra heat generated can be at least partly used to increase the temperature of the anode support structure (although it will be realized that the temperature of the anodes and anode support structure should be maintained below a maximum level). As the anode support structure is a relatively massive structure, the increase in temperature absorbs a large quantity of energy. When the cell returns to lower amperage operation, this energy can be recovered by heat extraction to lower the temperature of the anode structure. The recovered heat can be used for co-generation of electricity, which may be sold to the electricity grid. This electricity is generated during peak periods and supplements the amount of power available on the grid.

iv) Variable amperage operation enables the plant to optimise production efficiency by providing a way for cutting back production during down turns in demand and raising production during periods of high demand for the metal when the price is high.

In a preferred embodiment, positive and controlled heat extraction takes place in at least the anode support structure. It is especially preferred that the anode support structure used in the method of the present invention comprises the anode support structure described in the first aspect of the present invention.

The cell may further include heat exchange means in the bottom and side wall to provide further control of the heat balance in the cell. The heat exchange means may comprise forced convection heat exchanger pipes in the bottom and side wall.

The cooling fluid used to regulate heat extraction from the cell is preferably air. The air may be pre-heated prior to entering the heat exchange passages of the cell, which will assist in recovering high grade heat.

The cell is preferably fully insulated. The anode support structure preferably further includes heat exchanger means in the outer structure thereof.

The operating parameters that are monitored in the method of the present invention include one or more of the following:

anode temperature anode support structure temperature side wall temperature frozen ledge thickness bath temperature It will be appreciated that the above list is not exhaustive. The cell is preferably operated such that the value of a particular parameter is controlled within a set range. For example, the anode temperature may be controlled such that it falls within, say a 50° C. range.

The cell should include a control system adapted to monitor the desired operating parameters and control the rate of heat extraction from the cell. The rate of heat extraction may be controlled by regulating the flowrate and/or the inlet temperature of the cooling fluid.

BRIEF DESCRIPTION OF THE DRAWINGS

In order that the invention may be more readily understood, preferred embodiments of the invention will now be described with reference to the accompanying drawings in which:

FIG. 1 is a sectional end elevation of an aluminium smelting cell incorporating the continuous prebaked anode supporting structure embodying the invention;

FIG. 2 is a fragmentary schematic sectional plan view of the support structure shown in FIG. 1;

DESCRIPTION OF PREFERRED EMBODIMENTS

Figure 3:
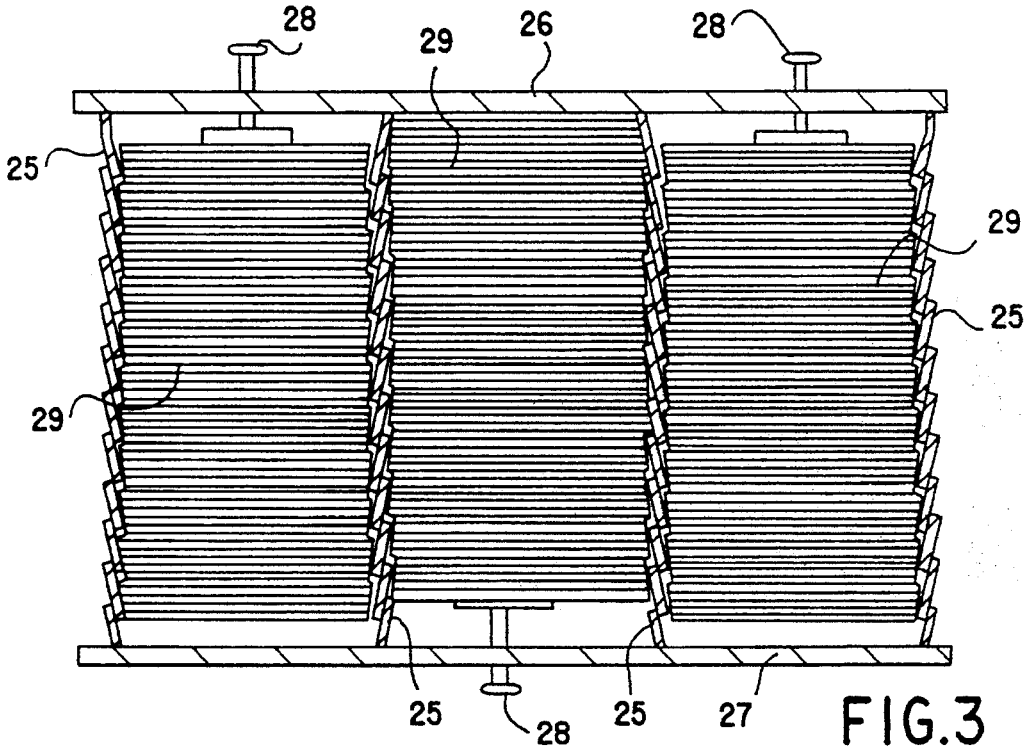
FIG. 3 is a schematic sectional plan view showing a simplified embodiment of the supporting structure embodying the invention.

Referring firstly to FIGS. 1 and 2 of the drawings, the continuous prebaked anode supporting structures 1 and 2 embodying the invention comprise rigid side walls 3 and 4 and rigid end walls 5, only one of which is shown in FIG. 2, supported at each corner by support posts 6 containing screw jack mechanisms 7, or the like, for raising and lowering the support superstructure defined by the side walls and end walls 3, 4 and 5 with respect to the aluminium smelting cell C shown schematically in FIG. 1 of the drawings. The side plates 3 and 4 and the end plates 5 are rigidly joined, say by welding, to define the rigid support superstructure, and the side walls and end wall 3 to 5 are preferably insulated in a manner not shown.

Extending between the side walls 3 and 4 are an array of spaced cross plates 8 and 9, which in the present embodiment comprise interconnected plate elements 10 defining a riffled configuration in each plate presenting individual wedging surfaces 12 which are engaged by corresponding wedging surfaces 13 formed along the sides of a continuous prebaked anode 14. The surfaces 13 on the anode 14 are forced into intimate contact with the wedging surfaces 12 on the riffled cross plates 8 and 9 by means of a screw jack 15 mounted on the side plate 3, or some other form of suitable clamping mechanism. The riffled cross plates 8 and 9 are rigidly secured to the side plates 3 and 4, say by tongue-and-groove connections or by bolts engaging flanges (not shown) on the cross plates 8 and 9 and secured to the side plates 3 and 4.

By varying the number of riffles on the cross plates, the contact pressure between the cross plates and the anode can be adjusted to a desired value. There are numerous riffle patterns suitable for use in the present invention and it is understood that the invention encompasses all such riffle patterns. It is also possible that the cross plates need not be riffled at all and they may present a flat face to the anode.

The space between the riffled cross plates 8 and 9 is used as a heat exchange passage, and therefore preferably includes air guiding baffles 16, shown schematically in FIG. 1 of the drawings, leading to hot air ducts 17 formed in the side plates 3 and 4, as shown schematically in FIGS. 1 and 2 of the drawings. Cooling ducts 17 facilitate the flow of cooling fluid in the heat exchange passages between the cross plates which serves to maintain the operating temperature of the superstructure in a suitable range to prevent high temperature creep and reduce heat losses.

In the embodiment shown in FIGS. 1 and 2 of the drawings, an alumina feed bin 18 containing a crust breaking mechanism 19 is positioned between the adjacent support structures 1 and 2, although alternative feed arrangements can be provided.

If desired, the cell side walls and bottom may incorporate heat exchange ducts 20, shown schematically in FIG. 1 of the drawings, whereby the heat balance of the entire cell may be more accurately controlled.

Figure 4:
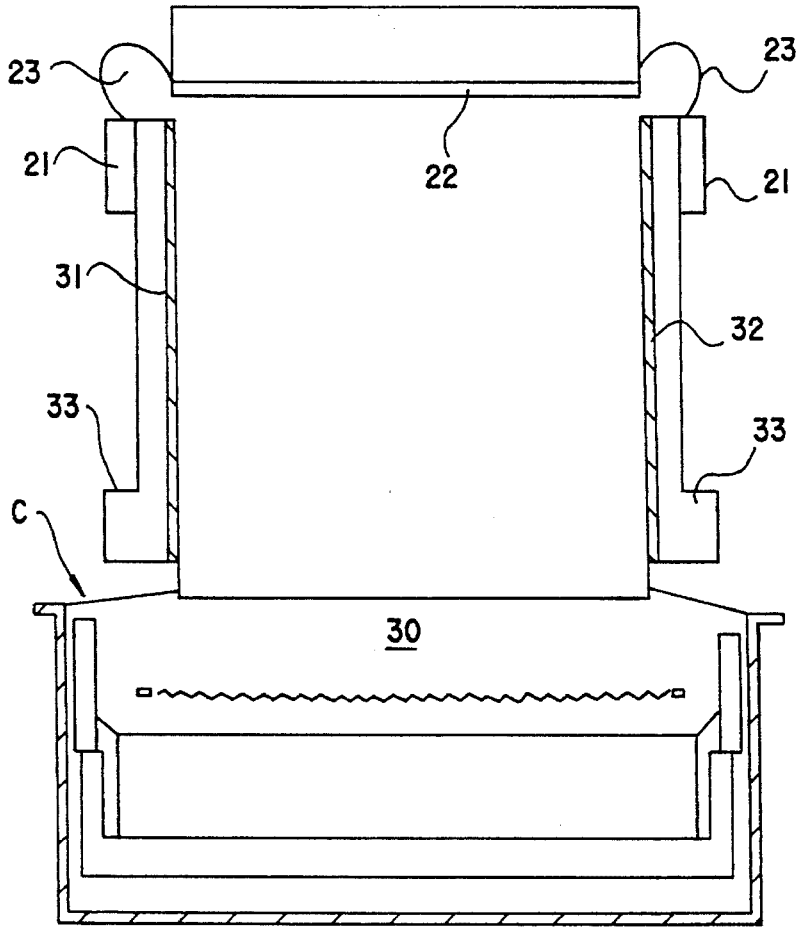
FIG. 4 is a sectional end elevation similar to FIG. 1 showing a modified heat exchange arrangement.

Current is fed to the anodes 14 via the riffled cross plates 8 and 9 by any suitable means, such as an anode ring bus 21 and a connecting bus 22 interconnected by anode tails 23, as shown schematically in FIG. 4 of the drawings.

By circulating air through the heat exchange spaces between the riffled plates 8 and 9 and into the ducts 17, the heat balance of the cell may be controlled and monitored by measuring the volume and temperature of the air flowing through the heat exchangers. In this way, process control would be enhanced by the ability to maintain the heat balance by selective removal of heat from the cell. Controlling the heat balance of the cell in this way enables the cell to be operated at variable amperage levels, which in turn enables the cell to be operated at higher amperage levels at times when low cost off-peak electricity is available. Furthermore, the extraction of high grade heat from the anodes using the above arrangement enables co-generation of electricity from this high grade heat.

In a preferred embodiment, the carbon anodes may be coated with sprayed aluminium. Alternatively, an aluminium cement or an aluminium powder may be applied between the cross plate and the anode carbon. By so doing, the electrical contact resistance between the anodes and the cross plates is lowered, which improves the efficiency of the cell. Close control of the temperature in the anode structure is required in this embodiment as the temperature must be maintained below the melting point of aluminium. The heat exchange passages between the plates allows the required close control of temperature to be effected.

The ability to control the temperature of the anode structure also allows the temperature to be maintained below that at which the mechanical properties of the construction materials of the anode support structure deteriorate.

Beam rising operations are carried out by slightly loosening the clamping means and moving the anode support structure upwardly while holding the anodes from moving.

A simplified embodiment of the invention is shown in FIG. 3 of the drawings in which single riffled cross plates 25 are positioned between the side plates 26 and 27, and clamping screws 28 mounted on the side plates 26 and 27 engage the anodes 29 to force the riffled sides of the anodes 29 into intimate contact with the plates 25.

In this embodiment, and in the previous embodiment, any open regions between the anodes and the supporting structure are preferably filled with alumina or other material compatible to the environment and to cell operation to prevent anode burn, provide a seal against escape of anode gases and reduce heat flow from the anodes to the superstructure.

In the embodiment shown in FIG. 4 of the drawings, a single anode structure 30 extends across the width of the cell C. Once again, The side plates 31 and 32 are formed with ducts 33 and the spaces between the riffled cross plates are baffled in a manner similar to the first embodiment.

Figure 5:
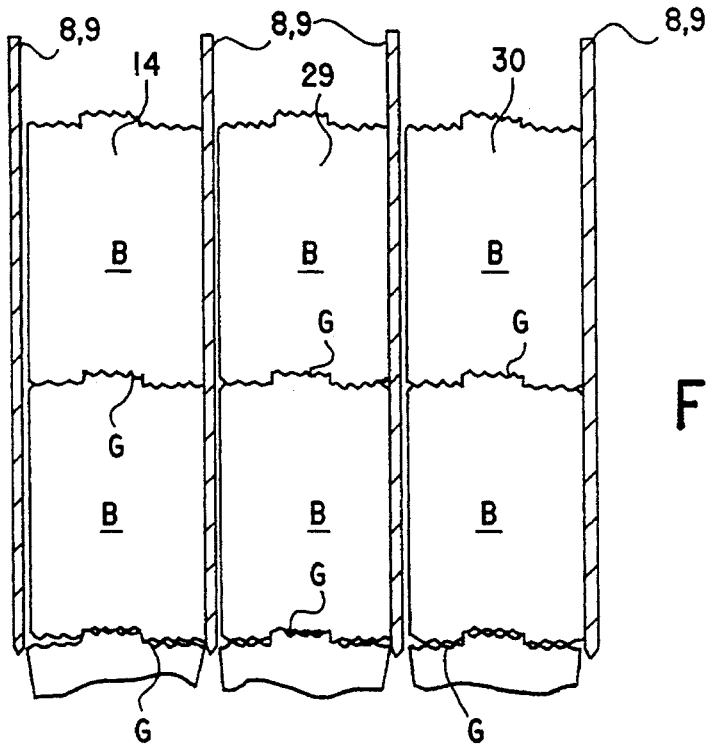
FIG. 5 is a schematic sectional end elevation showing one form of joint between adjacent anode blocks.

As shown in FIG. 5 of the drawings, the anode 14, 29 and 30 are formed from separate anode blocks B which are formed with interlocking profiles aimed at promoting adherence between the blocks B by means of a more secure glue joint G.

The cell C shown in FIGS. 1 and 4 of the drawings is preferably of a totally sealed design incorporating two levels of sealing. The lower anode and working cavity is preferably maintained under negative pressure with respect to the upper anode, whereas the upper anode is maintained at a negative pressure with respect to ambient. The cell is opened to atmosphere only during anode setting and beam rising operations (upper part) and during tapping (lower part).

In each of the above embodiments, the riffled cross plates ensure intimate contact between the current carrying cross plates and the correspondingly profiled sides of the continuous prebaked anodes. This arrangement provides a particularly simple yet rigid supporting structure for the anodes and enables the current to be introduced vertically into the anodes, thereby avoiding magnetic disturbance of the metal in the cell.

In the embodiments of FIGS. 1 and 2 and 4, the heat balance of the cell can be controlled and monitored by the heat exchangers built into the riffled cross plate structures. This enables the amperage of the cell to be varied to take advantage of off-peak electricity and further enables the heat recovered to be used for co-generation. Furthermore, it maintains this assembly in a suitable operating temperature range. This enables control of high temperature creep, protection of the cross plates from internal oxidation and the use of aluminium as a contact medium between cross-plates and anodes.

Figure 6:
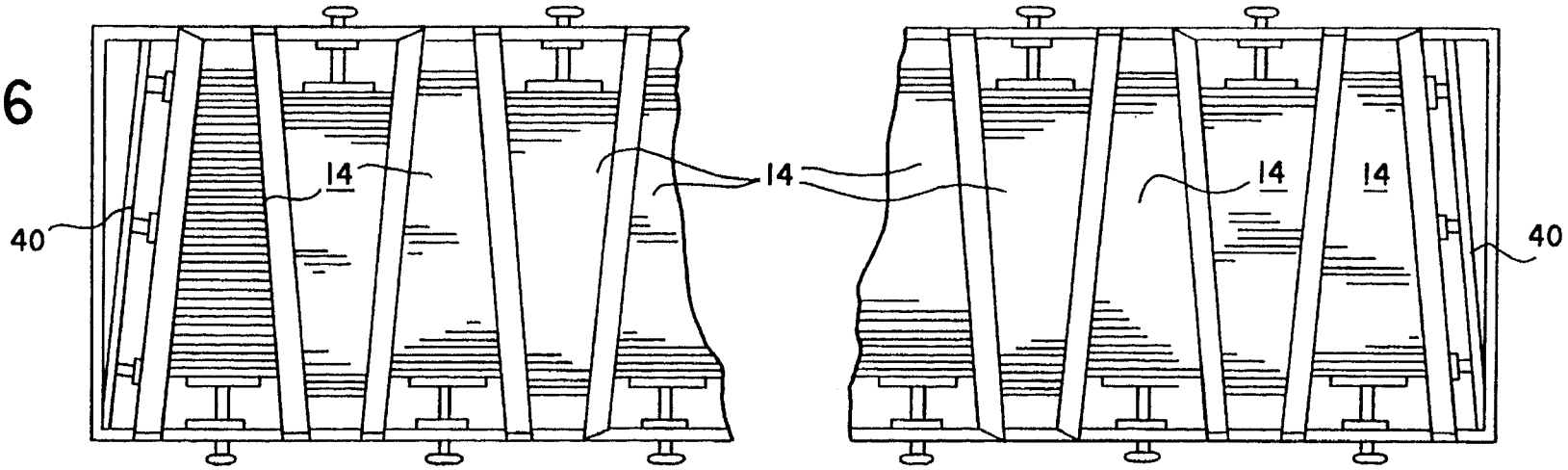
FIG. 6 shows a plan view of a further embodiment of the anode supporting structure of the present invention.
Figure 7:
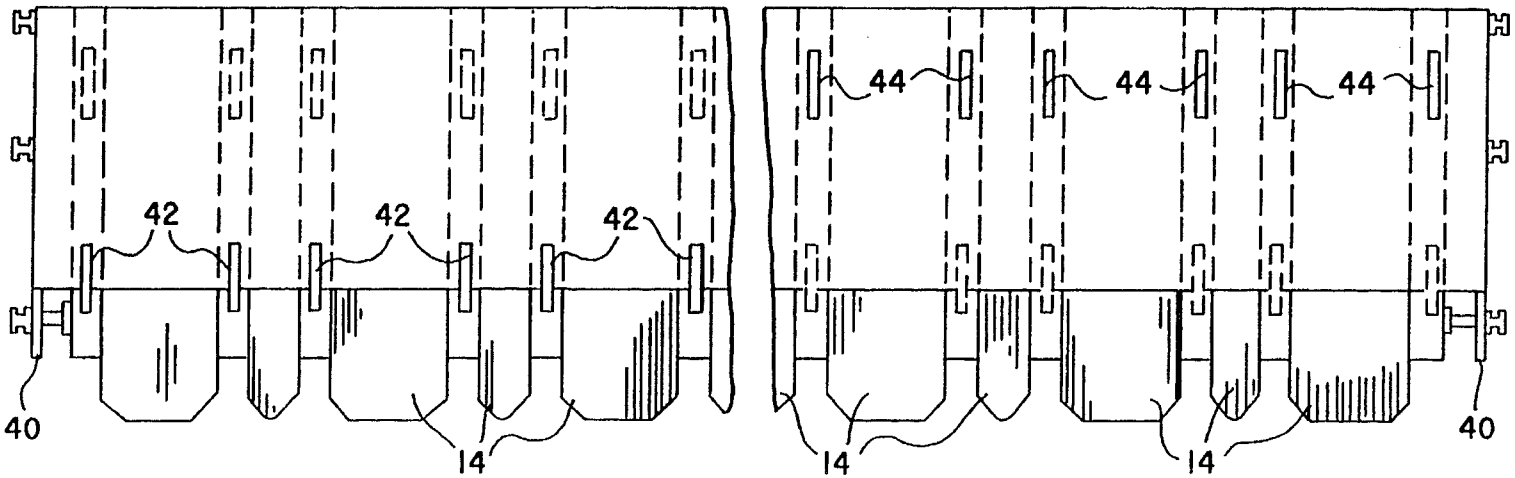
FIG. 7 is a side elevation of the embodiment shown in FIG. 6.

FIGS. 6 and 7 show a further embodiment of an anode support structure according to the present invention. The embodiments of FIGS. 6 and 7 are similar to those shown in FIGS. 1 and 2, with the addition of a contact pressure plate 40 to further enhance the support of the pre-baked anodes. Ducts 42 and 44, which allow the entry and egress of cooling air into the space between the cross plates, are clearly shown in FIG. 7.

Figure 8:
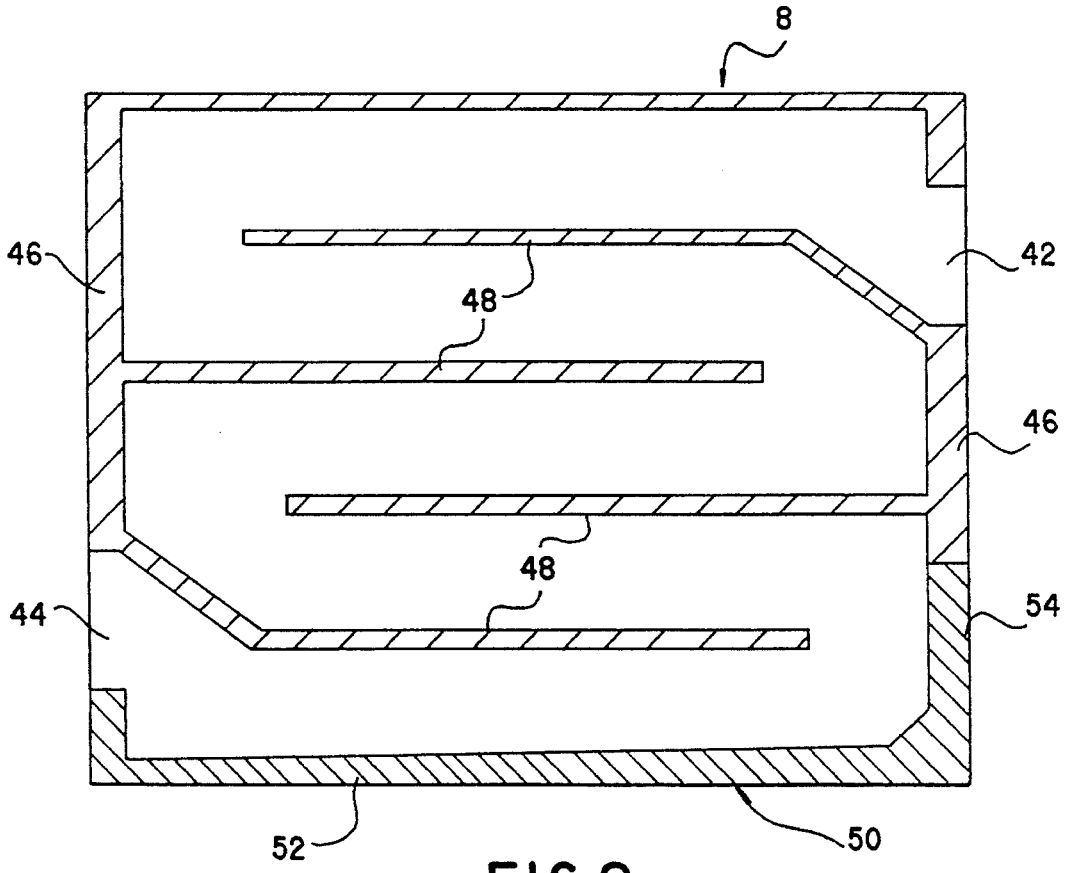
FIG. 8 is a side elevation of a cross plate suitable for use in the anode supporting structure of the invention.

FIG. 8 shows a side elevation of a preferred embodiment of the cross plates used in the anode supporting structure of the present invention. It will be appreciated that FIG. 8 shows the side of the cross plate facing away from the anode. The plate 8 includes raised edges 46 and baffles 48 which, together with inlet duct 42 and outlet duct 44, define a tortuous path for the flow of cooling air. Other heat transfer media may also be used in the place of cooling air.

Cross plate 8 also includes a current carrying member 50 which, in this embodiment, comprises a copper member. The copper member includes a horizontal portion 52 and a vertical riser portion 54. In use, vertical riser portion 54 is connected to the electricity supply for the cell (not shown). As the current carrying member 50 is located near the lower end of the anode support structure, the length of the path current which has to flow in the cell is reduced when compared to conventional cells and accordingly voltage loss is minimized. This design is especially suitable for low energy cell designs which employ wettable cathode where magnetic disturbances are negligible.

Cross plate 8 may be produced from any suitable material. The main requirement of the material of construction of the cross plates is that it has sufficient mechanical strength to support the anodes and that the mechanical strength of the cross plate is maintained at the temperatures reached in the anode structure during operation of the cell. A degree of electrical conductivity is also preferred, although the electrical conductivity of the cross plate need not be high, especially where current carrying member 50 forms part of the cross plate. Suitable materials of construction for the cross plate include mild steel and cast iron. The cross-plate may have a coating applied to the surface thereof. For example, molybdenum or refractory hard metal borides or carbides, such as $TiB_2$, TiC or $ZrB_2$ may be spray coated onto the cross-plate to provide a surface that is resistant to and wetted by aluminium.

As discussed earlier, in the embodiments shown in FIGS. 1 to 8, the heat balance of the cell can be controlled and monitored by the heat exchangers incorporated in the cross plates. This enables close control over the temperature of the anode structure, co-generation of electricity from the recovered heat and allows the amperage of the cell to be varied to take advantage of off-peak electricity supplies. In order to demonstrate this, a mathematical model of the cell incorporating the anode supporting structure of the present invention was developed. The mathematical model was used to calculate the heat flows in various parts of the cell and determine the overall temperature profile of the cell. Ohmic heat generation voltages were aligned with what is normally acceptable for pre-baked anode cells and pro-rated for operating the cell at selected amperages. The heat transfer coefficient at the bath/anode interface was also pro-rated to account for different anode current densities.

The thermal design and assessment criteria used for evaluating operating parameters of the cell were:

i) bath superheat to be above the critical for alumina dissolution;

ii) side walls should be protected by frozen ledge;

iii) subcathodic insulation should be thermally stable; and iv) temperature on the cathode surface should be high enough to prevent excessive ledge toe or hard sludge formation under the anode shadow.

Figure 9:
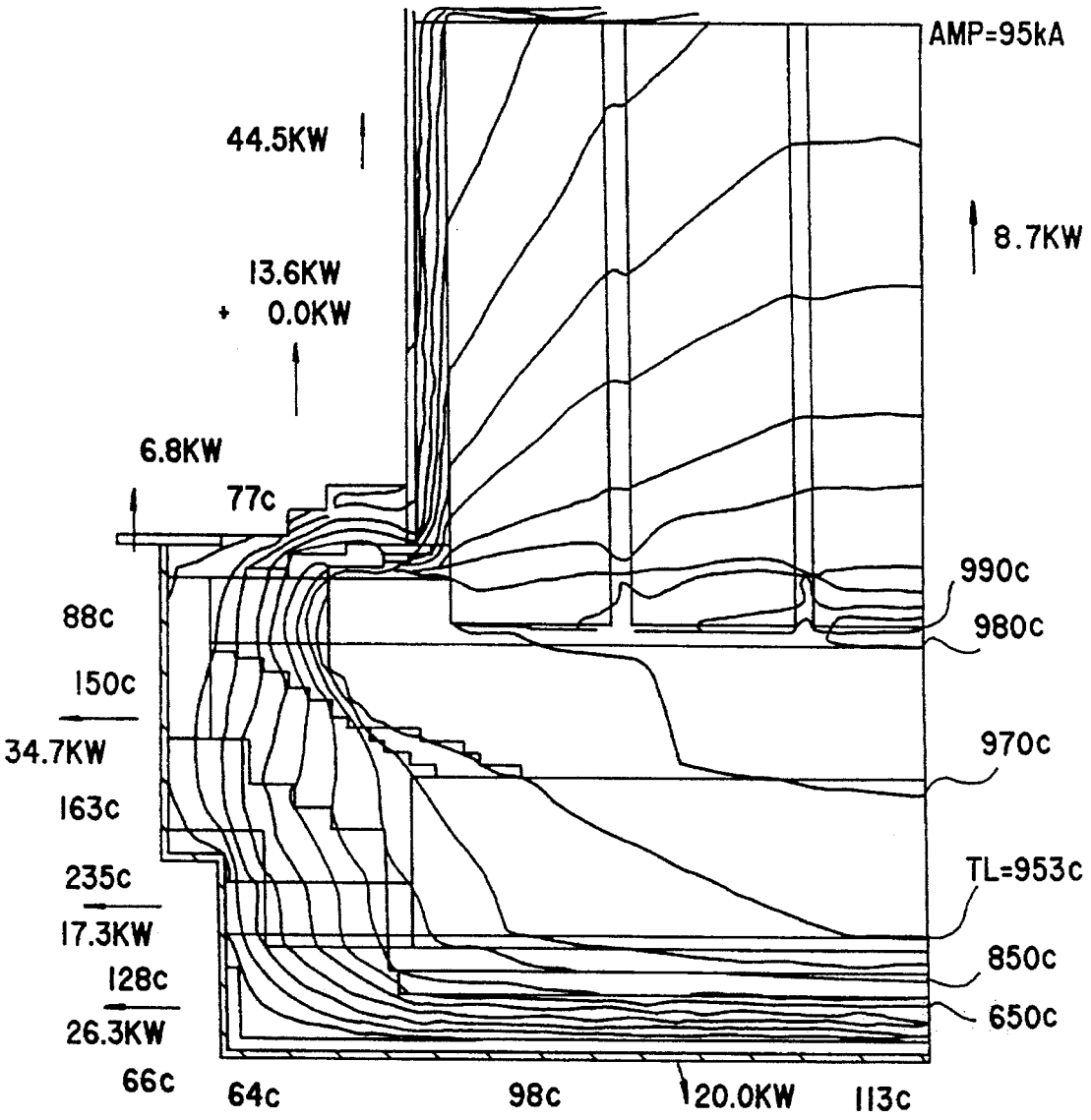
FIGS. 9, 10 and 11 show the thermal profiles obtained from a model of an electrolysis cell of the present invention.
Figure 10:
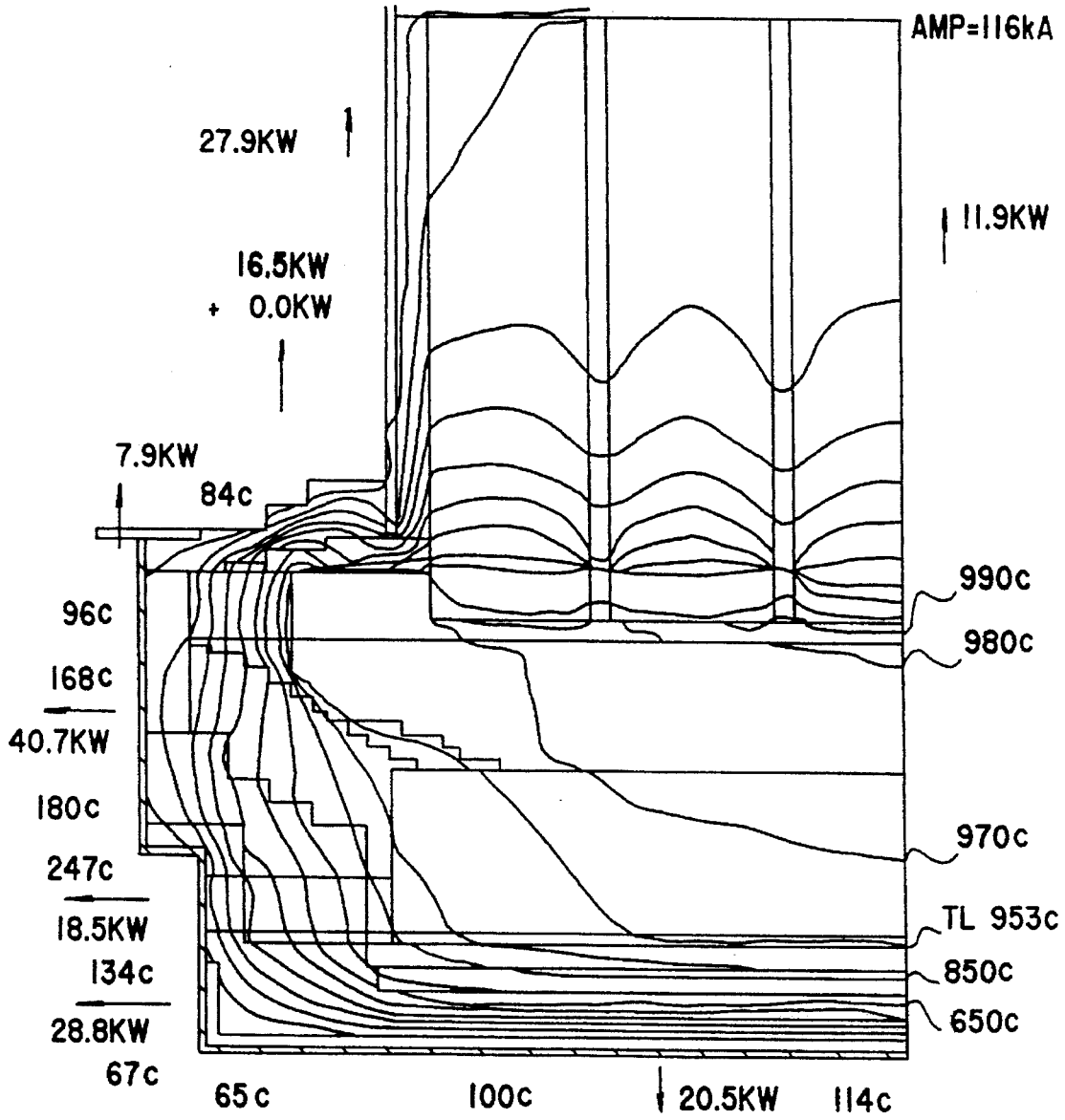
Figure 11:
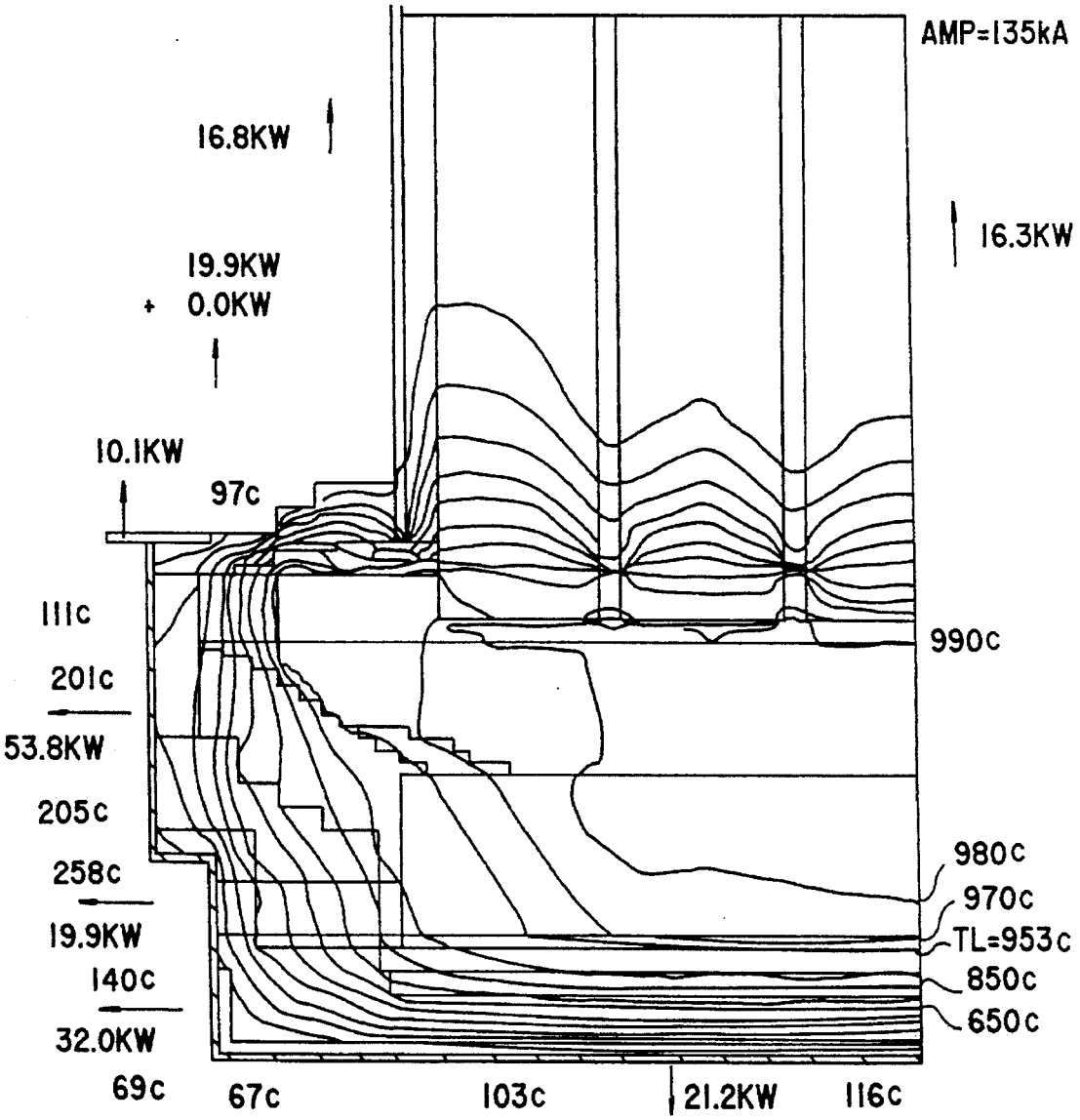

The thermal profiles obtained from the model under various conditions are shown in FIGS. 9 to 13. FIGS. 9, 10 and 11 show the operation of a cell incorporating the anode supporting structure of the present invention at varying amperages and power inputs with heat recovery in the anode supporting structure. Of critical importance for operation and longevity of the cell is the bath freeze isotherm (in this case, temperature equals 953° C.). This isotherm represents the extent of the frozen ledge and, in order to protect the side walls of the cell, this isotherm must extend beyond the side walls of the cell. As is shown in FIGS. 9 and 10, operating the cell at 95 kA and 116 kA with heat recovery in the anode supporting structure results in the formation of a frozen ledge having sufficient thickness to protect the side wall of the cell with an adequate safety margin. FIG. 11, which is a diagram of the thermal profile of a cell operating at 135 kA, shows that the frozen ledge just covers the side wall. This represents the upper operating conditions of the cell.

Figure 12:
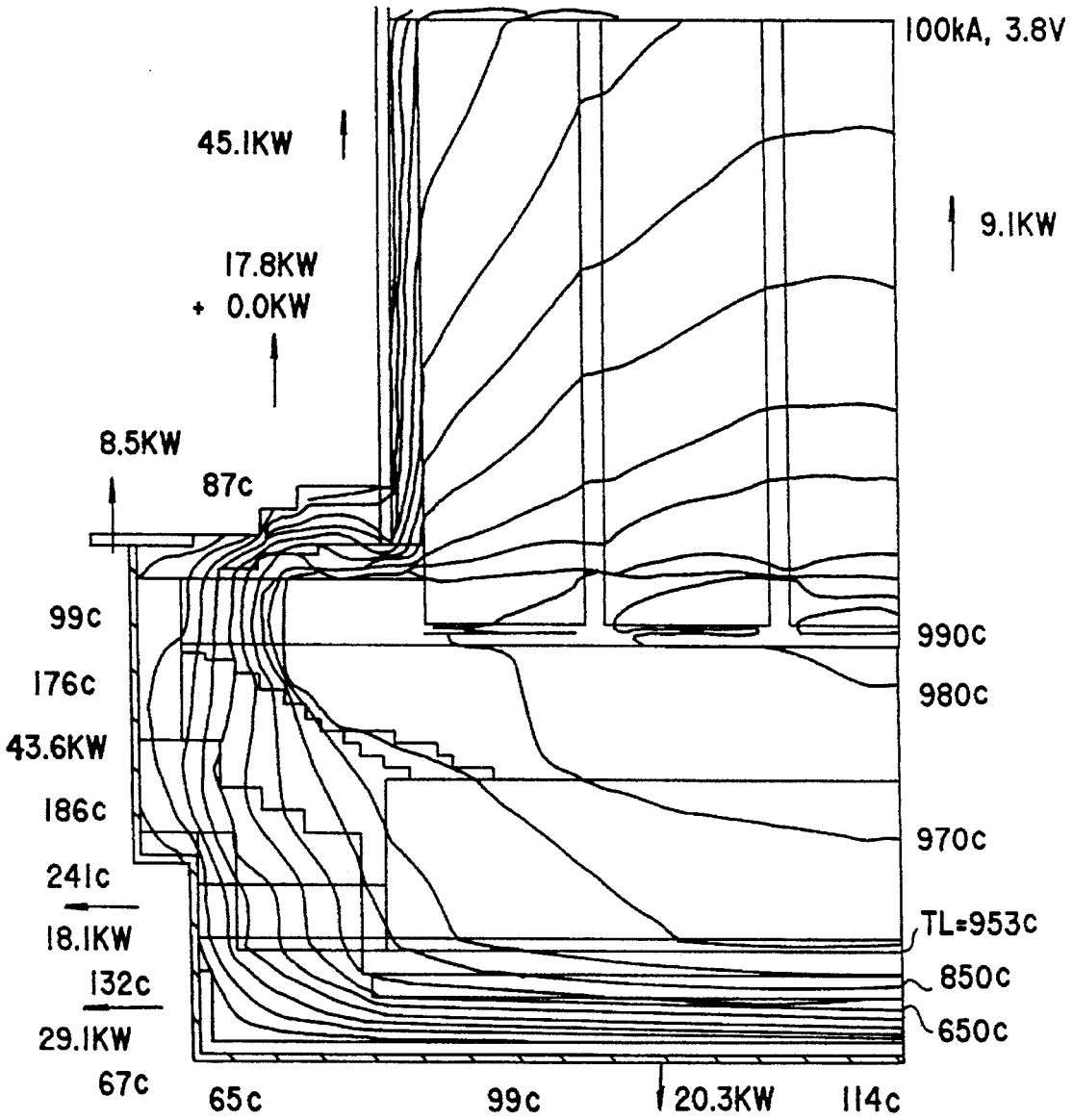
FIG. 12 shows the thermal profile obtained from a model of an electrolysis cell employing a conventional prebaked anode supporting structure.
Figure 13:
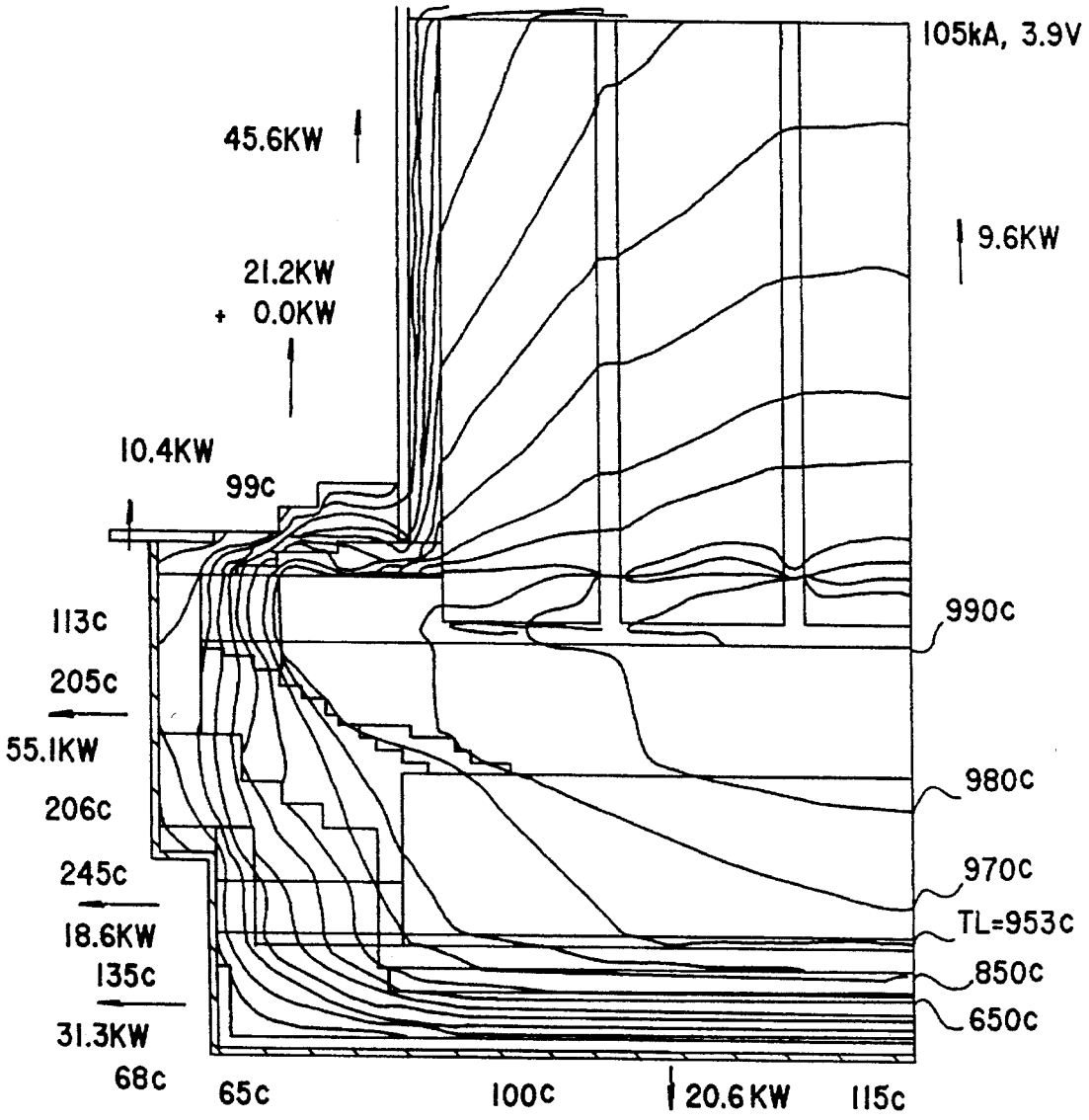
FIG. 13 shows the thermal profile obtained from a model of an electrolysis cell employing the anode supporting structure of the present invention without heat recovery being used.

FIGS. 12 and 13 show the thermal profile obtained for a conventional continuous pre-baked anode cell operated at an amperage of 100 kA and 105 kA without heat recovery in the anode structure. As can be seen, the frozen ledge barely covers the side wall of the cell, indicating that the upper limits of operating conditions of the cell have been reached at a much lower power input. In contrast, the cell incorporating the anode supporting structure of the present invention (which allows heat recovery) can be operated at an amperage of up to 135 kA. As amperage in the cell largely equates to metal produced in the cell, utilising the anode supporting structure of the present invention has the potential to increase metal production by a factor of 1.3, when compared to conventional cells.

The results of the thermal modelling of the cell are summarised in Table 1. These indicate that during operation at high amperage a relatively high amount of heat is generated (382 kW) and a large portion of this (192 kW) can be recovered from the anode. The results confirm that it is feasible to operate cells having the anode supporting structure of the present invention at a wide range of power inputs. Surplus heat can be recovered through the anode structure without adversely affecting the heat balance of the rest of the cell. In contrast, cells without heat extraction cannot be used for cyclic power operation without jeopardising their service life. If a cell of the present invention is operated in a cyclic mode, the results indicate that a portion of surplus heat (6000 kWh) can be stored in the anode assembly in the form of its internal energy. A portion of this (3000 kWh) could be subsequently recovered by cooling the assembly down. Therefore, the present invention can enable cyclic power operation which utilises the low cost energy during off-peak periods, and delayed heat recovery, which makes high grade heat available during peak periods, when the value of this recovered heat is much greater.

The heat extracted from the cell can be in the form of low grade heat or high grade heat, depending upon the requirements of the site at which the cell is located.

If low grade heat is required, cooling air may be fed into the heat exchange passages of the anode support structure at a low temperature, for example, from 20° C. to 100° C., and recovered at around 300° C. This recovered air is suitable for low pressure steam generation. Alternatively, if high grade heat recovery is required, such as would be the case where electricity generation on-site is desirable, the cooling air may be fed to the heat exchange passage at a relatively high temperature, for example, up to 300° C., and subsequently recovered at a temperature of around 500° C. This hot air could be passed to a boiler for producing steam suitable for electricity generation. The exhaust air from the boiler could subsequently be recycled as feed cooling air to the heat exchange passages. As will be appreciated by those skilled in the art, the recovery of low or high grade heat will be determined by site requirements and the desired operating conditions of the smelting cell.

Tests were carried out to determine contact resistances between various carbon anodes and cast iron cross-plates measured under industrial conditions for various combinations of contacting media, pressure and temperature. Tests were carried out on a special assembly mounted in a corner of an industrial size cell. The tests were carried out during the cell start-up, and the results are given in Table 2 below:

Table 3 shows The surface preparation/treatment and contact media at interface used. Both molybdenum and aluminium were arc sprayed onto the respective surfaces of cast iron and carbon. Current density in the test anode assembly was approximately. 1.7–1.8 Amp/$cm_2$.

The results show that acceptable contact resistances are obtainable under most likely operating conditions and with the use of "standard" and coated cross-plates and anodes.

These results also demonstrate the advantages of maintaining the anode/cross plate temperature below 600° C. and spraying the anode contacting surface with aluminium prior to engaging a cross-plate.

TABLE 1

| | | | | MODELLING RESULTS | | | | | | |
|---|---|---|---|---|---|---|---|---|---|---|
| Current | Input power | Q absorbed | Q cathode | Q anode | Q recov. | Q total | % recovered | Calc. Superheat | ACD | Heat Storage |
| kA | kW | kW | kW | kW | kW | kW | | °C. | mm | kWh |
| 95 | 352 | 171 | 105 | 67 | 0 | 972 | 0 | 8.2 | 58 | 6000 |
| 116 | 499 | 209 | 116 | 56 | 110 | 282 | 39 | 6.3 | 59 | 4300 |
| 135 | 639 | 243 | 137 | 53 | 192 | 382 | 50 | 9.1 | 56 | 3000 |
| 100 | 380 | 180 | 120 | 80 | 0 | 200 | 0 | 8.2 | 59 | |
| 105 | 409 | 189 | 136 | 84 | 0 | 220 | 0 | 10.5 | 60 | |

TABLE 2

| Pressure Temperature (°C.) | Test 1 500 | Test 2 600 | Test 3 500 | Test 4 700 |
|---|---|---|---|---|
| $kg/cm^2$ | mV | mV | mV | mV |
| 2.8 | 51 | 200 | 279 | 345 |
| 4.2 | 47 | 182 | 277 | 335 |
| 6.0 | 50 | 166 | 251 | 340 |
| 7.0 | 49 | 171 | 255 | 346 |

TABLE 3

| Test | Cast Iron | Carbon | Interface |
|---|---|---|---|
| 1 | Molybdenum | Aluminium | — |
| 2 | Molybdenum | — | — |
| 3 | — | — | graphite |
| 4 | — | — | — |

I claim:

1. A method for operating an electrolysis cell used in the production of aluminum, said cell including:

a shell having a bottom and side walls a cathode structure an anode support structure located above said cathode structure said anode support structure supporting one or more continuous pre-baked anodes said anode support structure including heat exchange means to enable heat extraction from said anode support structure, said method comprising locating one or more contact resistance reducing materials having a melting or degradation temperature below an operating temperature of the cell between the anode support structure and the one or more anodes and controlling a rate of heat extraction from said anode support structure such that temperatures in the anode support structure remain below a set temperature, said set temperature being chosen to avoid melting or degradation of said one or more contact resistance reducing materials.

2. A method as claimed in claim 1 wherein said step of locating one or more contact resistance reducing materials comprises applying an aluminum spray to said one or more anodes prior to placing said one or more anodes in the said anode support structure.

3. A method as claimed in claim 1 wherein the step of locating said one or more contact resistance reducing materials between said anode support structure and said one or more anodes comprises packing particulate aluminum between said anode supporting structure and said one or more continuous pre-baked anodes.

4. A method as claimed in claim 3 wherein the step of locating said one or more contact reducing materials between said anode support structure and said one or more anodes further comprises applying a coating of an electrically conductive material to surfaces of the anode support structure that contact said one or more continuous pre-baked anodes.

5. A method as claimed in claim 4 wherein said electrically conductive material is selected from the group consisting of molybdenum, copper, chromium, a refractory hard metal boride, a refractory hard metal carbide or mixtures thereof.

6. A method as claimed in claim 1 wherein the step of locating said one or more contact reducing materials between said anode support structure and said one or more anodes comprises applying a coating of an electrically conductive material to surfaces of the anode support structure that contact said one or more continuous pre-baked anodes.

7. A method as claimed in claim 6 wherein said electrically conductive material is selected from the group consisting of molybdenum, copper, chromium, a refractory hard metal boride, a refractory hard metal carbide or mixtures thereof.

8. A method as claimed in claim 1 wherein said anode support structure comprises a pair of rigid side plates and a pair of rigid end plates rigidly connected to define an enclosed supporting superstructure, at least one pair of spaced rigid electrically conductive cross plates configured to provide wedging surfaces against which correspondingly shaped side surfaces of said one or more continuous pre-baked anodes are held by clamping means supported by one of said side plates, means for introducing electrical current into said cross plates, elevating and lowering means carried by said supporting superstructure to facilitate proper positioning of the anode and feeding of the anodes with respect to the supporting structure, said support structure supports multiple anodes and the cross plates supporting adjacent anodes are spaced to define a heat exchange path therebetween, said method including passing a heat exchange medium along said heat exchange path to maintain said temperature in said anode support structure below said set temperature.

9. A method as claimed in claim 8 wherein said heat exchange path includes one or more baffles and the step of passing said heat exchange medium along said heat exchange path causes a flow of said heat transfer medium to pass over substantially an entire surface of the cross plates supporting adjacent anodes.

10. A method as claimed in claim 1 wherein one or more operating parameters of the cell are monitored and the rate of heat extraction from the cell is controlled to maintain one or more of the operating parameters within set limits, said rate of heat extraction is controlled to permit operation of the use at varying amperage.

11. A method as claimed in claim 10 wherein said cell is operated at high amperage during periods when off-peak electricity is available and operated at low amperage during peak periods.

12. A method as claimed in claim 11 wherein the temperature of the anode support structure is allowed to rise during high amperage operation to thereby store heat in said anode support structure and said stored heat is recovered during subsequent low amperage operation.

13. A method as claimed in claim 12 wherein the recovered heat is used to co-generate electricity.

* * * * *